US009656268B2

(12) United States Patent
Taylor

(10) Patent No.: US 9,656,268 B2
(45) Date of Patent: May 23, 2017

(54) SYSTEM AND METHOD FOR CUTTING AND/OR SHREDDING MATERIALS

(71) Applicant: Johnny Taylor, Tempe, AZ (US)

(72) Inventor: Johnny Taylor, Tempe, AZ (US)

(73) Assignee: Green Innovative Solutions, LLC, Tempe, AZ (US)

( * ) Notice: Subject to any disclaimer, the term of this patent is extended or adjusted under 35 U.S.C. 154(b) by 501 days.

(21) Appl. No.: 13/933,106

(22) Filed: Jul. 1, 2013

(65) Prior Publication Data

US 2014/0014755 A1 Jan. 16, 2014

Related U.S. Application Data

(60) Provisional application No. 61/666,469, filed on Jun. 29, 2012.

(51) Int. Cl.
*B02C 18/24* (2006.01)
*B02C 18/00* (2006.01)
*B02C 18/14* (2006.01)

(52) U.S. Cl.
CPC ..... *B02C 18/0084* (2013.01); *B02C 18/142* (2013.01); *B02C 18/145* (2013.01); *B02C 2018/147* (2013.01)

(58) Field of Classification Search
CPC ... B02C 18/24; B02C 18/0084; B02C 18/142; B02C 18/145; B02C 2018/147
USPC ..... 241/236, 159, 295
See application file for complete search history.

(56) References Cited

U.S. PATENT DOCUMENTS 2,472,725 A * 6/1949 Rundle ..... B02C 18/0084 241/157
3,880,361 A * 4/1975 Schwarz ..... B02C 18/142 241/191
5,141,168 A * 8/1992 Pepper ..... B02C 18/182 241/236
5,205,495 A * 4/1993 Garnier ..... B02C 18/0084 241/159
5,560,552 A * 10/1996 Powell ..... B02C 18/142 241/100
6,092,753 A * 7/2000 Koenig ..... B02C 18/142 241/236
8,157,014 B2 * 4/2012 Hariharan ..... E21B 21/001 166/357

(Continued)

*Primary Examiner* — Mark Rosenbaum
(74) *Attorney, Agent, or Firm* — Skaar Ulbrich Macari, P.A.

(57) ABSTRACT

A system for shearing bulk material includes a shearing cartridge with an input port and an output port. A first plurality of rotatable blades are disposed about a first shaft, Each of the first plurality of rotatable blades includes a center aperture such that the first shaft extends through the center apertures of the first plurality of rotatable blades to selectively rotate each of the first plurality of rotatable blades simultaneously. A second plurality of rotatable blades is opposingly offset from the first plurality of rotatable blades. Each of the second plurality of rotatable blades includes a center aperture such that the second shaft extends through the center apertures of the second plurality of rotatable blades to selectively rotate each of the second plurality of rotatable blades in a direction opposite the first plurality of rotatable blades to shear and reduce the bulk material.

20 Claims, 5 Drawing Sheets

(56) References Cited

U.S. PATENT DOCUMENTS

2002/0050538 A1* 5/2002 Fabio ..... B02C 18/142
241/88.4

* cited by examiner

SYSTEM AND METHOD FOR CUTTING AND/OR SHREDDING MATERIALS

PRIORITY

This Application claims priority to and the benefit of U.S. Provisional Patent Application No. 61/666,469, filed Jun. 29, 2012, which is hereby incorporated fully herein by reference.

TECHNICAL FIELD

The present invention is related generally to the field of cutting systems and, more particularly, to systems and methods for shearing or shredding materials.

BACKGROUND OF THE INVENTION

It has been reported that landfilling remains one of the most common way to dispose of municipal solid waste ("MSW") in the United States. According to certain United States Environmental Protection Agency statistics, of the 250.0 million tons of MSW generated in 2010, 136 million tons (54.2%) were landfilled. Residential waste (including waste from apartment houses) can account for approximately 55% to 65% of total MSW generation, and waste from commercial and institutional locations, such as businesses, schools, and hospitals can amount to approximately 35% to 45% of total MSW generation.

In the U.S., it is reported that approximately 34.1% of MSW consists of principally durable goods, such as aluminum, other non-ferrous metals, glass, plastics, wood, etc., and containers and packaging. As an example, the EPA has estimated that nine million refrigerators end up in landfills each year. Consumer materials—e.g., such as non-recyclable plastics—further contribute to the problem.

Additionally, construction and demolition materials ("C&D"), consisting of bulky, heavy materials, such as concrete, wood, metals, glass, and salvaged building components, generated during the construction, renovation, and demolition of buildings, roads, and bridges, and generates a substantial amount of landfilled materials.

These bulky materials often are items that have very little recyclable value or have limited reuse value due to a number of factors, including size, volume and material makeup. If these bulky items where sheared and shredded, the once bulky items could be used or repurposed as recyclable filler in products such as concrete (e.g., lightweight concrete), as refuse derived fuel, or other uses. Even if these once bulky items ultimately end up in landfills, considerable space would be saved as compared to the items in their original bulky states.

There are existing methods of causing MSW to be prepared for recycling purposes and for reuse. Currently, MSW items are sorted and characterized at transfer stations prior to sending MSW to a landfill. The end result is that only a small faction of the MSW actually is either reused or recycled. After a step after the sorting and characterization procedures, the shearing and shredding items can be marked for recycling, e.g., bottles, containers, plastics and the like, and transportation of these recycling items (once sheared and shredded), immediately increases the efficiency of transportation due to the reduced volume of these recyclable items. Additionally, by adding a step of shearing and shredding items after the sorting and characterization procedures, and determining what MSW is earmarked for landfills, the volume of items that are ultimately deposited into landfills is reduced but, more importantly, a large amount of these items now can be used for other purposes due to their reduced size.

Much of MSW are items that have very little recyclable value or have limited reuse value due to a number of factors, including size and volume. Without improvements in the current systems, procedures, and methods for dealing with MSW, the overall process will continue to be sub-optimal.

SUMMARY

A relatively self-contained cutting system comprises at least one replaceable cutting cartridge, where feedstock materials to be sheared and shredded ("Input"), are fed into an opening in the cutting system and the sheared and shredded output exits from a different opening in the cutting system ("Output"). Each replaceable cutting cartridge in each system comprises at least two interlocking sub-cartridges. Each sub-cartridge comprises a series of multiple rotary hook-like blades. Each rotary blade has specialized beveled teeth. Multiple cartridges can be coupled to operate in concert, allowing the Output from one cartridge to serve as Input to an adjoining cartridge. This "daisy chaining" functionality allows, for example, one replaceable cutting cartridge to shear and shred materials, and have the Output from that replaceable cutting cartridge serve as Input to another replaceable cutting cartridge to shear and shred the materials into smaller materials, and where the Output from the second replaceable cutting cartridge can serve as Input to still another replaceable cutting cartridge to shear and shred the resulting materials into still smaller materials. This expandable process can be repeated as necessary and/or desired, based on the specific application.

These bulky materials often are items that are initially fed into the system have very little recyclable value or have limited reuse value due to a number of factors, including size, volume and material makeup. If these bulky items where sheared and shredded, the once bulky items could be used or repurposed as recyclable filler in products such as concrete (e.g., lightweight concrete), as refuse derived fuel, or other uses. Even if these once bulky items ultimately end up in landfills, considerable space would be saved as compared to the items in their original states.

In one example embodiment, a system for shearing bulk material includes a shearing cartridge with an input port and an output port. A first plurality of rotatable blades are disposed about a first shaft, Each of the first plurality of rotatable blades includes a center aperture such that the first shaft extends through the center apertures of the first plurality of rotatable blades to selectively rotate each of the first plurality of rotatable blades simultaneously. A second plurality of rotatable blades is opposingly offset from the first plurality of rotatable blades. Each of the second plurality of rotatable blades includes a center aperture such that the second shaft extends through the center apertures of the second plurality of rotatable blades to selectively rotate each of the second plurality of rotatable blades in a direction opposite the first plurality of rotatable blades to shear and reduce the bulk material.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The preferred embodiments of the present invention will hereinafter be described in conjunction with the appended drawings, wherein like designations denote like elements, and.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention.

In certain embodiments, a replaceable cutting cartridge is provided. A plurality of cutting cartridges can also be used in series in a cutting/shredding device wherein materials to be sheared, shredded and/or granulized are fed into a first cartridge assembly, and the sheared and/or shredded materials from that first assembly are fed into a second cartridge assembly for further shearing, shredding and/or granulizing.

Figure 1:
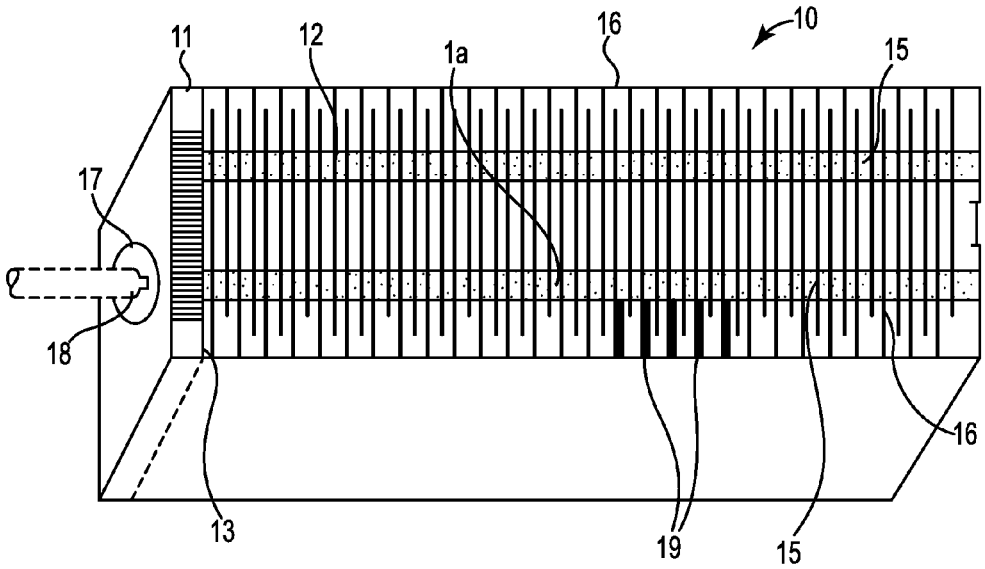
FIG. 1 is a perspective schematic view of the replaceable cutting cartridge system according to an embodiment of the present invention.

Referring first to FIG. 1, a replaceable cutting cartridge assembly 10 is provided. The cartridge comprises a plurality of sidewalls forming a frame or housing 11, twin interlocking blade sub-cartridges 12 disposed within the frame and a gearbox compartment 14 defined on one end of the frame 11. The gearbox compartment is separated by a mid-wall 13 from the portion of frame containing the blade assemblies 12. The separation reduces the likelihood that debris would enter the drive gears and cause a jam.

Each sub-cartridge or blade assembly 12 includes a shaft 15 along which a plurality of rotary blades 16 are disposed. Each rotary blade 16 comprises a plurality of specialized teeth as will be discussed with respect to FIG. 2.

Each shaft 15 is locked to a gear on one end as will be discussed below. A coupling 17 is provided to an outer longitudinal end of the frame adjacent to the gear box 13. An input shaft 18 can supply the drive input means to the gearbox 13, which will then rotate all of the shafts together. In a preferred embodiment, the gearbox 13 is configured to match the rotational velocities of the adjacent blades.

The teeth or tines 20 of the respective adjacent blades of the sub-cartridges are intermeshed or overlapped partially with one another. This configuration can also be seen in FIGS. 2 and 3. This configuration operates in conjunction with the blade tooth profile shown in FIG. 2 to rip, tear, cut and/or shred the material introduced into the cartridge assembly. The gap (e.g., FIG. 3) between the opposing blade tips 20 where the blades intermesh can be approximately 0.004". This spacing is defined by disposing spacers on the shafts 15 between each blade 16 as desired depending on the shearing and bulk material applications and needs.

In addition to shearing or shredding the material that comes into contact with the blade assemblies, the angle, alignment and rotating configuration of the blades 16 and tines 20 pull the material down into the assembly once contact with the material is established.

Each of the plurality of blades 16 within each sub-cartridge, intermeshes with a corresponding opposing blade 16 on the opposing shaft 15 or the adjacent sub-cartridge, without touching such opposing blade as each sub-cartridge 26 rotates. Each series of blades within each sub-cartridge is calibrated, positioned, and aligned for optimal shearing and shredding force.

Additionally, a plurality of fixed finger members 19 can be provided to the inside surfaces of the longitudinal frame walls (e.g., FIG. 1), and along a select portion or the entire length of the wall. The finger members 19 extend out from the side wall to approximately the shaft 15 nearest the respective sidewall from which the finger 19 extends. The fingers 19 are disposed in the larger space gap between opposing blades 16. The fingers 19 preferably extend the full length of the longitudinal sides. The fingers 19 function to reduce the likelihood that material passes by the blades along the sidewalls without being shredded through the interface of the blades 16. The fingers also reduce the buildup of material on the sides of the blades 16 and on the shaft 15 portions between adjacent blades.

Figure 2:
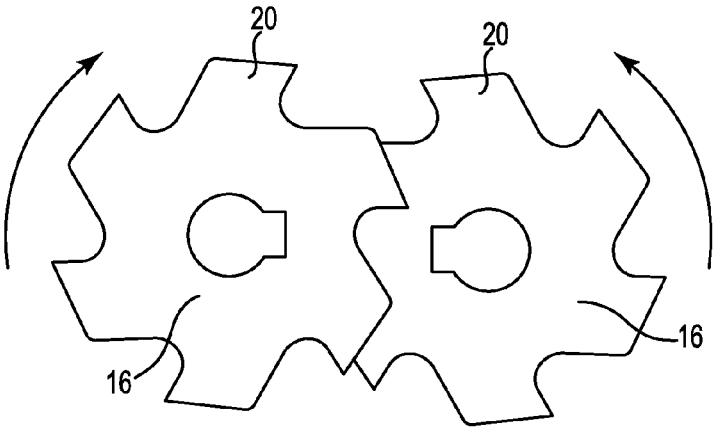
FIG. 2 is an end view of adjacent overlapping, or intermeshing, blade assemblies in the cutting cartridge system according to an embodiment of the present invention.
Figure 3:
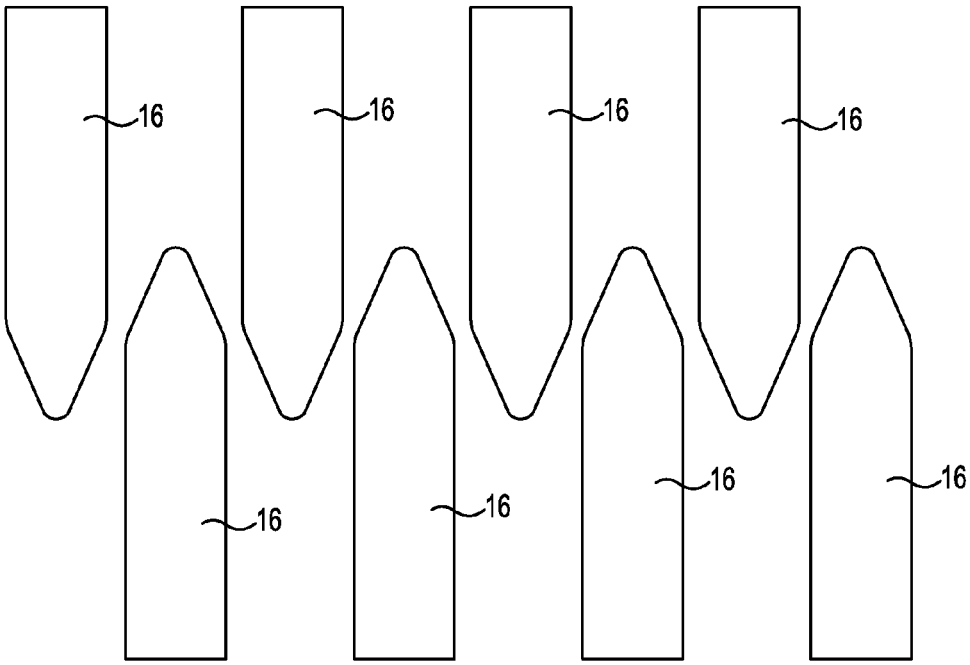
FIG. 3 is a top view of adjacent overlapping, or intermeshing, blade assemblies in the cutting cartridge system according to an embodiment of the present invention.

Referring to FIG. 2, the tooth 20 profile of the gears 16 can be seen. To enhance shredding or shearing, the specialized beveled teeth profile of each rotary blade within the series of blades are aduncous or hamulate (e.g., "hook-like") in form. Each tooth 20 can include a planar surface, a gullet, and an angled surface extending between the planar surface and the gullet via a rounded transition surface. Accordingly, in each sub-cartridge, the arcuate or angled hook-like shape of the blade teeth 20 causes materials introduce at the mouth of the cutting system to be "hooked" and "pulled" into the cutting system as the hook-like teeth of the blades grab the feedstock material. Once the feedstock material enters into the cutting system, the feedstock material is sheared and then shredded. The pinch point and gullet shape of the opposing and intermeshed blade teeth 20 can cause six points or ways of shearing the feedstock material.

Since the drive mechanism that powers the rotating blades is preferably very powerful, the act of grabbing the feedstock material and "pulling" the feedstock material into the cutting system is powerful, which allows very large objects to be fed into the cutting system. As feedstock material is fed into the cutting system, the specialized beveled and hook-like teeth 20 of each rotary blade 16 first shears and grabs to the material fed into the cutting system, and as each rotary blade rotates, the material is further "pulled" into the cutting system. In one example embodiment, a ½"×½" blade spec (thickness and length of gullet at end of each tip 20) will make every small block of material the same, or approximately the same size—approximately ½"×½".

Figure 4:
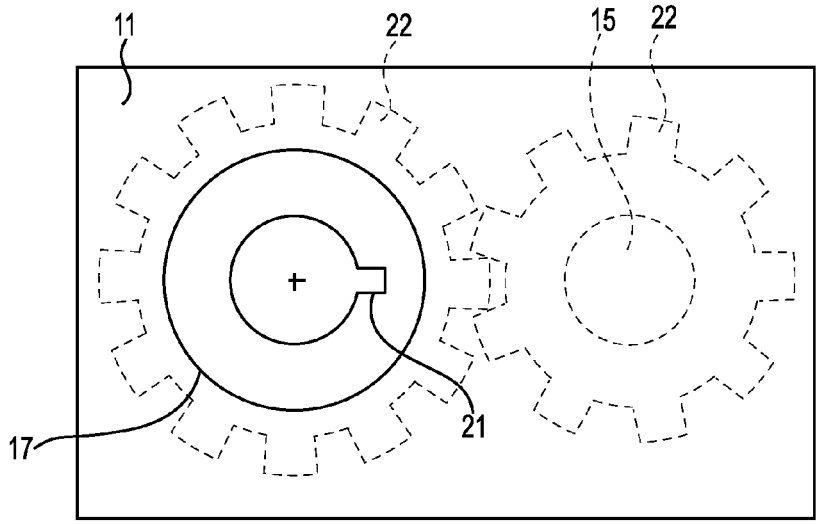
FIG. 4 is an end view of the cutting cartridge according to an embodiment of the present invention.

Referring now to FIG. 4, the replaceable cutting cartridge assembly includes at least one coupling 17 on one longitudinal end of the cartridge frame 11. Each coupling 17 is keyed or includes a notch 21 to receive a corresponding drive shaft 18 (shown in FIG. 1). This permits a drive shaft 18 to rotate the coupling 17, thereby driving the blades 16 in the cartridge assembly via the gearbox 13. Here, the dashed lines show the end of the second shaft 15 and two gears 22 in an exact 1:1 ratio to ensure alignment of blade tips 20 to pull in and shear material. A bearing or bushing for supporting the rotation of the blade shafts 15 can be provided for reliability and life span. An electric motor, gas engine or other means can be provided to drive the input shaft (e.g., 318).

Figure 5:
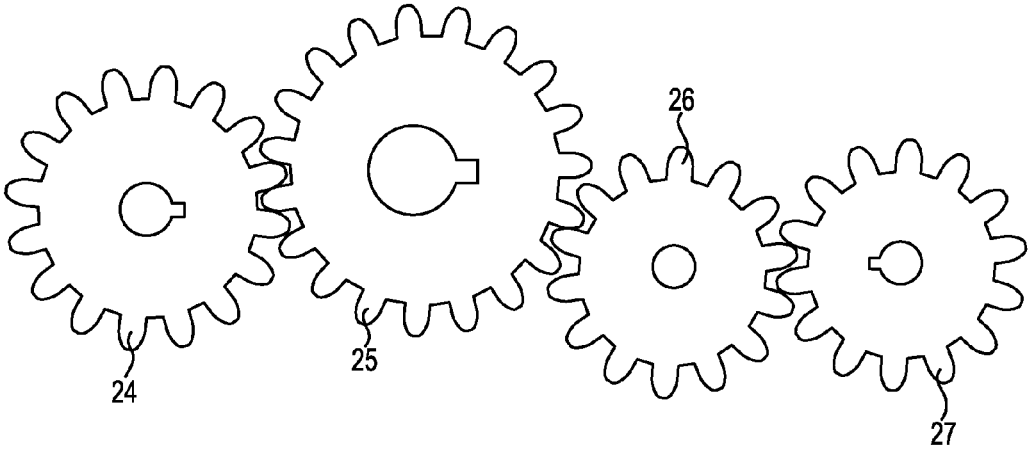
FIG. 5 is a diagram of a gear drive system for cutting cartridge system according to an embodiment of the present invention.

Referring now to FIG. 5, one example of a gearbox assembly 13 is shown. First, it is noted that the cutting cartridge assembly 10 may comprise more than two blade sub-cartridges. In the embodiment shown in FIG. 5, the gearbox illustrates a four sub-cartridge configuration and corresponding gears 24-27. Those skilled in the art will recognize that the gearbox can be modified to match the number of blade sub-cartridges provided in a given cutting cartridge assembly.

The single input shaft drives the first gear 24 on which the shaft 15 is directly coupled. The teeth of the first gear 24 mesh with the second gear 25, to drive that gear as the first gear is rotated. Subsequent gears, 26 and 27, etc. can be driven in the same manner. The gear ratios are selected so that each sub-cartridge rotates at the exact same pitch velocity. In various embodiments of the present invention, each sub-cartridge rotates in the opposite direction of the adjacent sub-cartridge(s) as a result of the gear construct. In an alternative embodiment, each sub-cartridge shaft is powered by its own direct drive means, such as an electric motor, diesel engine, etc.

Figure 6:
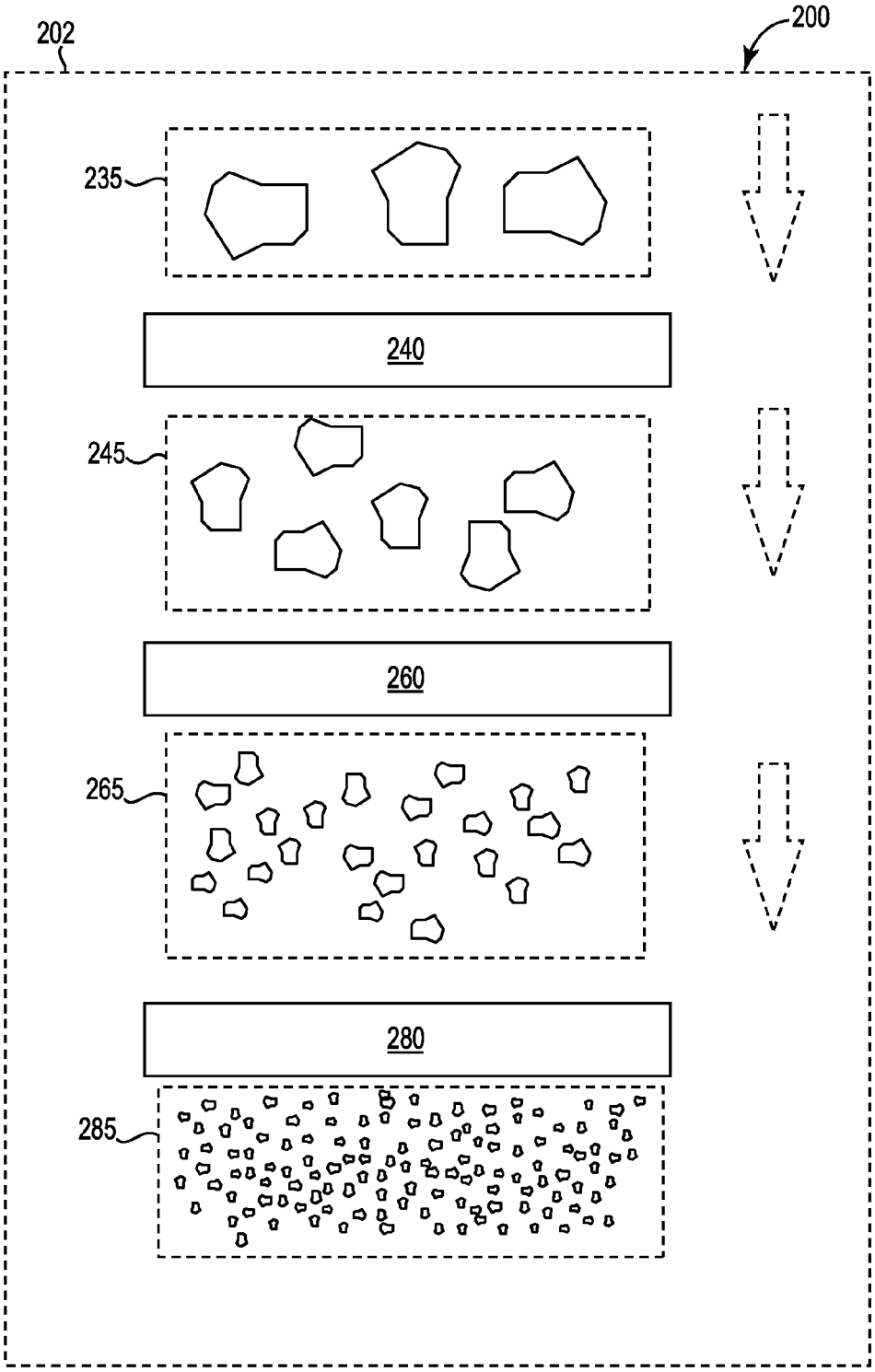
FIG. 6 is a schematic block diagram of a cutting/shredding device according to an embodiment of the present invention.

Referring now to FIG. 6, a shredding/granulizing system 200 is shown according to certain embodiments of the present invention. As shown, a plurality of cutting cartridge devices 240, 260 and 280 are "daisy-chained" within a single large housing 202. Each successive cutting cartridge thus transforms the respective feedstock into successively smaller output to achieve a final material size that is smaller than can be achieved with a single cartridge (e.g., 10). For example, large particle starting feedstock 235 is introduced into first cutting system cartridge 240 to generate an output of smaller size particles 245. That smaller output 245 is then the input to second cartridge 260, which makes the particles even smaller 265 as its output. The smaller particles 265 are then the feedstock for third cartridge 280, which outputs the final desired size particles 285. In this fashion, the end result can be material as small as necessary and/or desired for a specific application by simply coupling as many or as few cutting cartridges together as necessary to achieve the desired result.

Each cartridge stage 240, 260 and 280 can be geared together to allow a single drive input means (e.g., 17, 18) to drive the entire apparatus or system. Alternatively, each stage can be provided with its own direct drive means.

Figure 7:
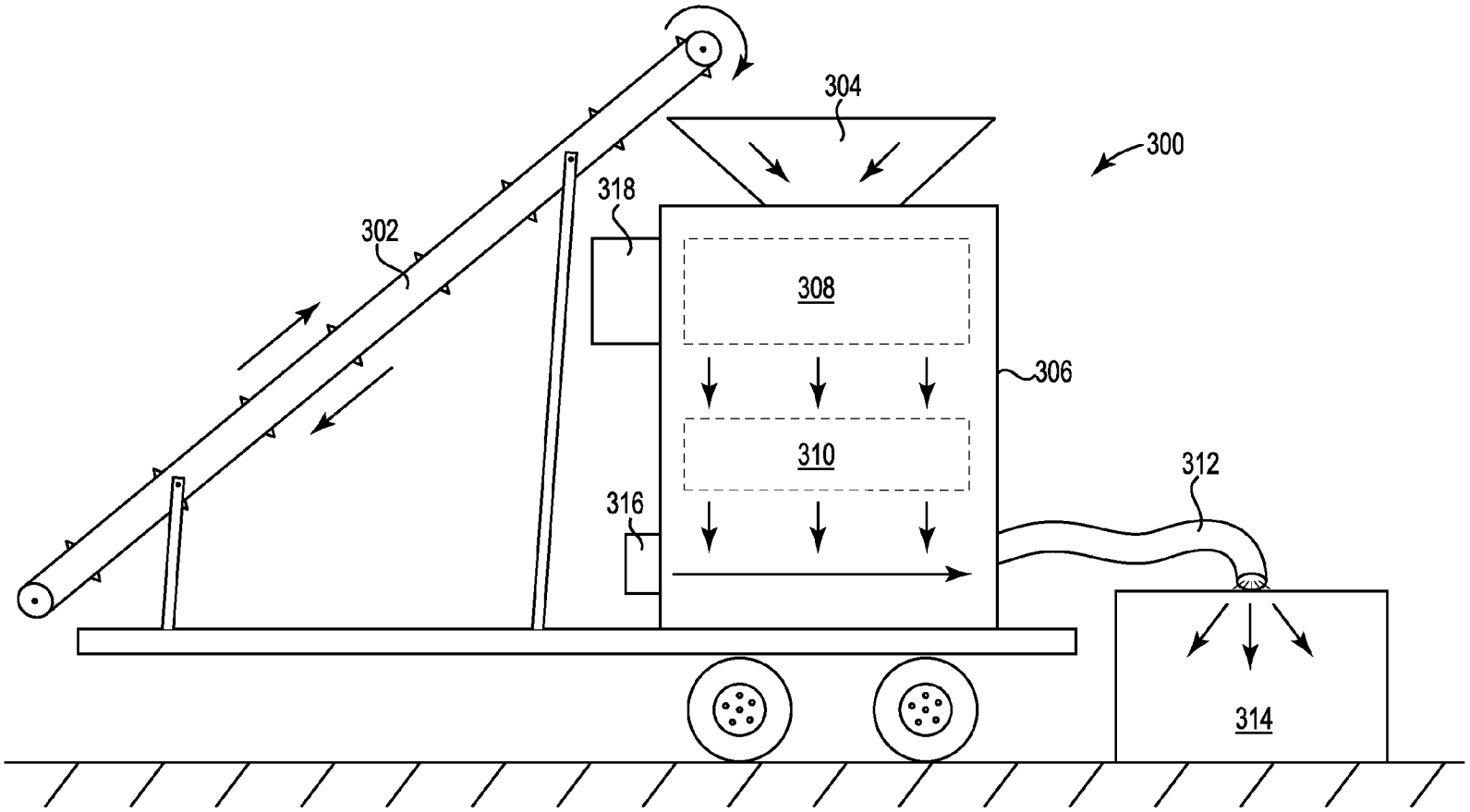
FIG. 7 is a side view of a cutting/shredding system and device according to an embodiment of the present invention.

Referring now to FIG. 7, a cutting/shredding system 300 according to an exemplary embodiment is shown. The system 300 is configured as a tow-behind or mobile implementation. However, other configurations and non-mobile configurations can be used without departing from the scope of the invention. A conveyor 302 is provided to convey feedstock from a loading point up to a hopper or input aperture 304 of the cutting assembly 306. The feedstock is then processed through the assembly 306 (e.g., dual stages 308 and 310, or a single cartridge such as cartridge 10). An output conduit 312 is provided after the last stage to deliver the final particles to a container 314 or like structure. A blower 316 or other suitable mechanism can be included in assembly 306 to force the final particles through the output conduit. Drive means is shown as item 318 and can be any suitable means, such as those discussed herein. Further, the output conduit 312 can be another conveyor assembly or like means of feeding the outputted material away from the system.

In the most preferred embodiments of the present invention, each cutting cartridge is removable and replaceable. The preferred embodiment would support the removal of the accepting shafts from the notched beam couplings and the decoupling of a support structure holding the cutting cartridge. In addition, one or more of the plurality of blades 16 provided on the shafts 15 can be removed, replaced, sharpened, etc.

From the foregoing description, it should be appreciated that the cutting system disclosed herein presents significant benefits that would be apparent to one skilled in the art. Furthermore, while multiple embodiments have been presented in the foregoing description, it should be appreciated that a vast number of variations in the embodiments exist. Lastly, it should be appreciated that these embodiments are preferred exemplary embodiments only and are not intended to limit the scope, applicability, or configuration of the invention in any way. Rather, the foregoing detailed description provides those skilled in the art with a convenient road map for implementing a preferred exemplary embodiment of the invention, it being understood that various changes may be made in the function and arrangement of elements described in the exemplary preferred embodiment without departing from the spirit and scope of the invention as set forth in the appended claims.

The invention claimed is:

1. A system for shearing bulk material, comprising:

a shearing cartridge including an input port and an output port;

a first plurality of rotatable blades and a first shaft, each of the first plurality of rotatable blades including a center aperture and a plurality of first shearing surfaces having a first tooth planar surface, a first gullet, and a first angled planar surface extending between the first tooth planar surface and the first gullet via a first rounded transition surface, such that the first shaft extends through the center apertures of the first plurality of rotatable blades to selectively rotate each of the first plurality of rotatable blades simultaneously; and a second plurality of rotatable blades and a second shaft, the second plurality of rotatable blades opposingly offset from the first plurality of rotatable blades, each of the second plurality of rotatable blades including a center aperture and a plurality of second shearing surfaces having a second tooth planar surface, a second gullet, and a second angled planar surface extending between the second tooth planar surface and the second gullet via a second rounded transition surface, such that the second shaft extends through the center apertures of the second plurality of rotatable blades to selectively rotate each of the second plurality of rotatable blades in a direction opposite the first plurality of rotatable blades to shear and reduce the bulk material.

2. The system of claim 1, further including a second shearing cartridge having a second input port and a second output port such that the second input port is in communication with the output port of the shearing cartridge.

3. The system of claim 2, wherein the second shearing cartridge further includes:

a third plurality of rotatable blades and a third shaft, each of the third plurality of rotatable blades including a center aperture such that the third shaft extends through the center apertures of the third plurality of rotatable blades to selectively rotate each of the third plurality of rotatable blades simultaneously; and a fourth plurality of rotatable blades and a fourth shaft, the fourth plurality of rotatable blades opposingly offset from the third plurality of rotatable blades, each of the fourth plurality of rotatable blades including a center aperture such that the fourth shaft extends through the center apertures of the fourth plurality of rotatable blades to selectively rotate each of the fourth plurality of rotatable blades in a direction opposite the third plurality of rotatable blades.

4. The system of claim 1, wherein the shearing cartridge includes an external shaft input in operative communication with the first shaft and the second shaft.

5. The system of claim 4, further including a plurality of interlocked gears operatively interconnected with the first shaft, the second shaft and the external shaft input such that spinning of the external shaft input correspondingly spins the first shaft and the second shaft to rotate the first plurality of rotatable blades and the second plurality of rotatable blades.

6. The system of claim 1, wherein each of the first plurality of rotatable blades include a plurality of arcuate hooked ends.

7. The system of claim 1, wherein each of the second plurality of rotatable blades include a plurality of arcuate hooked ends.

8. The system of claim 1, wherein the first plurality of rotatable blades and the first shaft are selectively removable from the shearing cartridge independent of the second plurality of rotatable blades and the second shaft.

9. The system of claim 1, further including a hopper in operative communication with the shearing cartridge to deliver the bulk material to the shearing cartridge.

10. The system of claim 9, further including a conveyor assembly in operative communication with the hopper to deliver the bulk material to the hopper.

11. A system for shearing bulk material, comprising:

a hopper having an input and an output, the input adapted to receive bulk material;

a shearing cartridge including an input port and an output port, the input port in operative communication with the output of the hopper;

a first plurality of rotatable blades and a first shaft, each of the first plurality of rotatable blades including a center aperture and a first plurality of shearing surfaces having a first tooth planar surface, a first gullet, and a first angled planar surface extending between the first tooth planar surface and the first gullet via a first rounded transition surface, such that the first shaft extends through the center apertures of the first plurality of rotatable blades to selectively rotate each of the first plurality of rotatable blades simultaneously;

a second plurality of rotatable blades and a second shaft, the second plurality of rotatable blades opposingly offset from the first plurality of rotatable blades, each of the second plurality of rotatable blades including a center aperture and a plurality of second shearing surfaces having a second tooth planar surface, a second gullet, and a second angled planar surface extending between the second tooth planar surface and the second gullet via a second rounded transition surface, such that the second shaft extends through the center apertures of the second plurality of rotatable blades to selectively rotate each of the second plurality of rotatable blades in a direction opposite to and in a 1:1 rotating relationship with the first plurality of rotatable blades to pull in, shear and reduce the bulk material; and an output delivery system in operative communication with the output port to receive the reduced bulk material and deliver it away from the shearing cartridge.

12. The system of claim 11, further including a second shearing cartridge having a second input port and a second output port such that the second input port is in communication with the output port of the shearing cartridge.

13. The system of claim 12, wherein the second shearing cartridge further includes:

a third plurality of rotatable blades and a third shaft, each of the third plurality of rotatable blades including a center aperture such that the third shaft extends through the center apertures of the third plurality of rotatable blades to selectively rotate each of the third plurality of rotatable blades simultaneously; and a fourth plurality of rotatable blades and a fourth shaft, the fourth plurality of rotatable blades opposingly offset from the third plurality of rotatable blades, each of the fourth plurality of rotatable blades including a center aperture such that the fourth shaft extends through the center apertures of the fourth plurality of rotatable blades to selectively rotate each of the fourth plurality of rotatable blades in a direction opposite the third plurality of rotatable blades.

14. The system of claim 11, wherein the shearing cartridge includes an external shaft input in operative communication with the first shaft and the second shaft.

15. The system of claim 14, further including a plurality of interlocked gears operatively interconnected with the first shaft, the second shaft and the external shaft input such that spinning of the external shaft input correspondingly spins the first shaft and the second shaft to rotate the first plurality of rotatable blades and the second plurality of rotatable blades.

16. The system of claim 11, wherein each of the first plurality of rotatable blades include a plurality of arcuate hooked ends.

17. The system of claim 11, wherein each of the second plurality of rotatable blades include a plurality of arcuate hooked ends.

18. The system of claim 11, wherein the first plurality of rotatable blades and the first shaft are selectively removable from the shearing cartridge independent of the second plurality of rotatable blades and the second shaft.

19. The system of claim 11, further including a conveyor assembly in operative communication with the hopper to deliver the bulk material to the hopper.

20. The system of claim 11, wherein the first plurality of shearing surfaces and the second plurality of shearing surfaces are beveled.

* * * * *